US008895218B2

(12) United States Patent
Kojima et al.

(10) Patent No.: US 8,895,218 B2
(45) Date of Patent: Nov. 25, 2014

(54) CARRIER CORE MATERIAL AND CARRIER FOR ELECTROPHOTOGRAPHIC DEVELOPER AND PROCESS FOR PRODUCING THE SAME, AND ELECTROPHOTOGRAPHIC DEVELOPER USING THE CARRIER

(75) Inventors: Takashi Kojima, Kashiwa (JP); Toru Iwata, Kashiwa (JP); Koji Aga, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 1005 days.

(21) Appl. No.: 12/685,756

(22) Filed: Jan. 12, 2010

(65) Prior Publication Data

US 2010/0196818 A1 Aug. 5, 2010

(30) Foreign Application Priority Data

Feb. 4, 2009 (JP) ..... 2009-023337

(51) Int. Cl.

| | |
|---|---|
| ***G03G 9/00*** | (2006.01) |
| ***G03G 9/107*** | (2006.01) |
| ***G03G 9/113*** | (2006.01) |

(52) U.S. Cl.

CPC ..... *G03G 9/1075* (2013.01); *G03G 9/1131* (2013.01); *G03G 9/1133* (2013.01); *G03G 9/1136* (2013.01)

USPC ..... 430/111.3; 430/111.34; 430/111.4; 430/111.41

(58) Field of Classification Search

USPC ..... 430/111.32, 111.1, 111.31, 137.1, 430/137.2

See application file for complete search history.

(56) References Cited

U.S. PATENT DOCUMENTS

2007/0141502 A1 * 6/2007 Aga et al. ..... 430/111.32

FOREIGN PATENT DOCUMENTS

| | | |
|---|---|---|
| JP | 2005-162597 | 6/2005 |
| JP | 2006-524627 | 11/2006 |
| JP | 2006-337828 | 12/2006 |

* cited by examiner

*Primary Examiner* — Thorl Chea

(74) *Attorney, Agent, or Firm* — Greenblum & Bernstein, P.L.C.

(57) ABSTRACT

Employment of a carrier core material for an electrophotographic developer containing 0.8 to 5% by weight of Mg, 0.1 to 1.5% by weight of Ti, 60 to 70% by weight of Fe and 0.2 to 2.5% by weight of Sr and having an amount of Sr dissolved with a pH4 standard solution of 80 to 1000 ppm, a carrier using the core material and a process for producing them, and an electrophotographic developer using the carrier.

15 Claims, No Drawings

CARRIER CORE MATERIAL AND CARRIER FOR ELECTROPHOTOGRAPHIC DEVELOPER AND PROCESS FOR PRODUCING THE SAME, AND ELECTROPHOTOGRAPHIC DEVELOPER USING THE CARRIER

TECHNICAL FIELD

The present invention relates to a carrier core material and a carrier for an electrophotographic developer used in two-component electrophotographic developers used for copiers, printers, etc., and a process for producing them, and an electrophotographic developer using the carrier.

BACKGROUND ART

The electrophotography development method is a method achieved by adhering toner particles contained in a developer to an electrostatic latent image formed on a photoreceptor. The developers used in this method are classified into two-component developers consisting of toner particles and carrier particles and one-component developers consisting of only toner particles.

Among the developers described above, the cascade method were employed in the past as a development method which uses the two-component developer consisting of toner particles and carrier particles, but the current mainstream is a magnetic brush method using a magnet roll.

In the two-component developer, the carrier particle serves as a carrier material to form a toner image on a photoreceptor by being stirred with toner particles in a development box filled with a developer, imparting the intended charge to the toner particles, and further transferring the thus charged toner particles to the surface of the photoreceptor. The carrier particles remained on a developing roll having a magnet return again to the developing box from the developing roll, and are mixed and stirred with new toner particles for repeated use for a certain period of time.

In two-component developers, unlike one-component developers, carrier particles are mixed and stirred with toner particles to charge the toner particles and further functions to transfer the toner particles, thereby providing good controllability when designing a developer. Consequently, the two-component developer is suitable for full color developing apparatuses which require high image quality and apparatuses used for high-speed printing which require reliability and endurance in image maintenance, etc.

In two-component developers used in such a manner, image properties such as image density, fogging, white spot, gradation, resolution, etc., need to exhibit a determined value from the initial stage. Further, these properties must not fluctuate during toner life and need to be stably maintained. To stably maintain these properties, it is essential that the properties of the carrier particle contained in a two-component developer be stable.

Conventionally, an iron powder carrier, such as iron powder having the surface thereof coated with an oxide film or iron powder having the surface thereof coated with a resin, has been used for the carrier particle forming a two-component developer. These iron powder carriers have high magnetization and high conductivity, thereby being advantageous in that an image with good solid portion reproducibility is easily provided.

However, such an iron powder carrier has a heavy true specific gravity of about 7.8 and magnetization which is also too high. Consequently, the toner components tend to fuse on the surface of iron powder carriers, so-called "toner spent", from the stirring and mixing with the toner particles in a developing box. The occurrence of such a toner spent decreases the effective carrier surface area, causing the frictional chargeability with the toner particles to be deteriorated.

In a resin-coated iron powder carrier, the resin on the surface may peel off due to the stress during use, exposing the core material (iron powder) having a low breakdown voltage owing to a high conductance, whereby charge may be leaked. The electrostatic latent image formed on the photoreceptor breaks down from such a charge leakage, thus causing brush strokes or the like to occur on the solid portions, making it difficult to produce a uniform image. For these reasons, iron powder carriers, such as an oxide film coated iron powder or a resin coated iron powder, are currently no longer used.

Recently, a ferrite having a light true specific gravity of about 5.0 and low magnetization is used as carrier in place of the iron powder carriers, and a resin coated ferrite carrier coated with a resin on the surface thereof is increasingly used, whereby the developer life has been remarkably extended.

The method for producing such a ferrite carrier is typically carried out by mixing a determined amount of ferrite carrier raw materials, subsequently calcining, crushing and granulating, followed by sintering. The calcining may not have to be performed under a certain condition.

Incidentally, considering the recent more strict environmental regulations, metals such as Ni, Cu, Zn, etc., are now remotely used, and the use of metals in compliance with the environmental regulations are demanded. Accordingly, the ferrite constituent compositions used as the carrier core material have shifted from Cu—Zn ferrite and Ni—Zn ferrite to Mn ferrite, Mn—Mg—Sr ferrite, etc., which use Mn.

Japanese Patent Laid-Open No. 2006-337828 describes a ferrite carrier core material for an electrophotography whose surface is divided into 2 to 50 sections with grooves or lines per 10 μm square and which contains manganese ferrite as a principle component. Such a ferrite carrier core material has a uniform composition, constant surface properties, good fluidity, high magnetization and low resistivity. The electrophotographic developer using the ferrite carrier having such a ferrite carrier core material coated with a resin exhibits a quick charge rise property and is hence thought to have a stable charge level for long time use.

To produce the ferrite carrier core material as described above, Japanese Patent Laid-Open No. 2006-337828 discloses a production method in which a compound oxide containing as principle components Fe and Mn in an Fe to Mn molar ratio (Fe/Mn) of 4 to 16 is pulverized, mixed, granulated and sintered, and further crushed and classified, wherein the sintering is carried out under an atmosphere having an oxygen concentration of 5% by volume or less.

However, Mn is becoming a subject of various laws and regulations. In response to this movement, new carrier core materials free of not only various heavy metals described above but also Mn are demanded.

As an alternative to the carrier core material containing Mn, carrier core materials containing Mg are proposed. For example, Japanese Patent Laid-Open No. 2005-162597 discloses an Mg ferrite material (carrier core material) represented by the formula $X_aMg_bFe_cCa_dO_e$ (wherein X represents Li, Na, Ti, etc., or a combination thereof) having a saturated magnetization of 30 to 80 emu/g and a breakdown voltage of 1.5 to 5.0 kV, and that this Mg ferrite material can meet the demands in high image quality and environmental regulations.

Japanese Domestic Re-Publication of PCT Publication No. 2006-524627 discloses an Mg ferrite material (carrier core material) represented by the formula $Mg_aFe_bCa_cO_d$ having a saturated magnetization of 30 to 80 emu/g and a breakdown voltage of 1.5 to 5.0 kV, composed of clean materials in compliance with the environmental regulations, providing high image quality that is clear, enhanced in tone and free of fogging.

Despite the proposal of the carrier core material containing Mg as described above, the compatibility of the properties between high magnetization and medium to high resistivity is hard to achieve since the magnetization and resistivity are generally in the trade-off relationship. For this reason, Mn is added to modify the trade-off relationship between the magnetization and resistivity and attain high magnetization with medium to high resistivity, and such an Mn-added core material is thus currently used as the carrier core material for electrophotographic developers. However, as described earlier, the situation is changing against the Mn use as the regulations on various heavy metals are reinforced.

Even with the Mg carrier core material to which Mn is not intentionally added, there is a method for achieving high magnetization and medium to high resistivity by the conventional sintering. That is, the attempt has been made in which the resistivity is adjusted to a desired level by oxidizing the surface after the final sintering, but it is still not enough to solve the trade-off relationship described above.

Further, it is conventionally known that the magnetization can be raised by producing the Mg ferrite using an excessive amount of Fe. However, as a result of the excessive amount of Fe, the resistivity is extremely low. Furthermore, the Fe-excessive Mg ferrite is characterized by the sudden decrease of magnetization caused by the surface oxidization or a high oxygen concentration at the final sintering. The oxidization of divalent Fe contained in the magnetite is considered to be responsible for this phenomenon.

On the other hand, the sintering temperature for the Mg ferrites which do not contain a transition metal other than Fe is as high as about 1250 to 1350° C. Further, the only obtainable surface property required for the carrier core material is a surface with little ruggedness, and many non-spherical particles are contained since the carrier core material particles tend to coagulate each other during the sintering. As a result, a carrier core material for an electrophotographic developer, which is intentionally free of heavy metals, has high magnetization, medium to high resistivity and the surface properties having the right degree of ruggedness with uniform topography, is not yet obtained at present.

DISCLOSURE OF THE INVENTION

Problem to be Solved by the Invention

In view of the above, an object of the present invention is to provide, substantially without using heavy metals other than Mn, a carrier core material for an electrophotographic developer which has high magnetization and yet renders a desirable resistivity of medium or high resistivity, together with good charge properties and even the surface properties of having the right degree of ruggedness and uniform topography, a carrier using the core material and a process for producing them as well as an electrophotographic developer using the carrier which has an extended life, a high charge level and good charge stability.

Means for Solving the Problems

The present inventors conducted extensive studies to solve the above problems and found that the above object can be achieved by the carrier core material containing a certain amount of Mg, Ti, Fe and Sr, having an amount of Sr dissolved with a pH4 standard solution within a specific range, and desirably containing an oxide crystal structure containing at least Fe and Ti other than the spinel structure forming the Mg ferrite and the carrier having such a core material covered with a resin, whereby the present invention was accomplished.

More specifically, the present invention provides a carrier core material for an electrophotographic developer which comprises 0.8 to 5% by weight of Mg, 0.1 to 1.5% by weight of Ti, 60 to 70% by weight of Fe and 0.2 to 2.5% by weight of Sr and from which 80 to 1000 ppm of Sr is dissolved with a pH4 standard solution.

The carrier core material for an electrophotographic developer of the present invention contains Mn in an amount of preferably 0.1 to 10% by weight.

The carrier core material for an electrophotographic developer of the present invention preferably contains an oxide crystal structure containing at least Fe and Ti in addition to the spinel structure forming the Mg ferrite.

The carrier core material for an electrophotographic developer of the present invention preferably has a true density of 4.5 to 5.3 g/cm$^3$.

The carrier core material for an electrophotographic developer of the present invention preferably has a charge level of 0.8 to 2 times relative to an Mn—Mg ferrite core material.

The carrier core material for an electrophotographic developer of the present invention preferably has a BET specific surface area of 0.075 to 0.15 m$^2$/g.

The carrier core material for an electrophotographic developer of the present invention preferably has a magnetization of 55 to 85 Am$^2$/kg, a residual magnetization of 2 to 10 Am$^2$/kg, and a coercive force of 10 to 80 3K·1000/4π·A/m, when a magnetic field of 3K·1000/4π·A/m is applied.

The carrier core material for an electrophotographic developer of the present invention preferably has an average particle size of 15 to 120 μm when measured using a laser diffraction particle size distribution analyzer.

The carrier core material for an electrophotographic developer of the present invention preferably has a shape factor SF-2 (circularity) of 100 to 120.

The carrier core material for an electrophotographic developer of the present invention preferably has a volume resistivity of $1\times10^6$ to $1\times10^{10}$ Ω·cm at an applied voltage of 50 V.

The carrier core material for an electrophotographic developer of the present invention desirably is subjected to surface oxidation treatment to form an oxide film thereon, and preferably has a volume resistivity of $1\times10^6$ to $1\times10^{10}$ Ω·cm at an applied voltage of 50 V and a volume resistivity of $6\times10^5$ to $1\times10^{10}$ Ω·cm at an applied voltage of 1000 V.

The present invention provides a carrier for an electrophotographic developer having the surface of carrier core material described above coated with a resin.

In the carrier for an electrophotographic developer of the present invention, the above resin is desirably an acrylic resin, silicone resin or modified silicone resin.

The present invention further provides a process for producing a carrier core material for an electrophotographic developer which comprises crushing, mixing and subsequently granulating each compound of Fe, Ti, Mg and Sr, subjecting the obtained granulated product to the first sintering and final sintering, and further crushing, classifying and subjecting to the surface oxidation treatment, wherein the final sintering is carried out at an oxygen concentration of 5% by volume or lower.

The present invention provides a process for producing a carrier for an electrophotographic developer which comprises covering the surface of carrier core material obtained by the above production process with a resin.

The present invention provides an electrophotographic developer which comprises the above carrier or the carrier obtained by the above production process, and a toner.

The electrophotographic developer of the present invention is also used as a replenishing developer.

Effect of the Invention

The carrier core material for an electrophotographic developer of the present invention provides high magnetization, yet an intended resistivity of medium or high resistivity, and has good charge properties together with the surface properties having the right degree of ruggedness and uniform topography without using various heavy metals or Mn in an amount more than necessary. Further, the electrophotographic developer composed of the toner and carrier obtained by covering the above carrier core material with a resin has an extended developer life and a high charge level with good charge stability. According to the production process of the present invention, the above carrier core material and carrier can be stably produced in an industrial scale.

BEST MODE FOR CARRYING OUT THE INVENTION

The best mode to carry out the present invention is described hereinafter.

<Carrier Core Material and Carrier for Electrophotographic Developer of the Present Invention>

The carrier core material for an electrophotographic developer of the present invention contains 0.8 to 5% by weight, preferably 0.8 to 4% by weight and more preferably 0.8 to 3.8% by weight of Mg, 0.1 to 1.5% by weight, preferably 0.15 to 1.25% by weight, and more preferably 0.2 to 1.25% by weight of Ti, 60 to 70% by weight, preferably 60 to 68.5% by weight, and more preferably 60 to 67% by weight of Fe, and 0.2 to 2.5% by weight, preferably 0.2 to 2% by weight, and more preferably 0.22 to 2% by weight of Sr. When a composition is within the above ranges, high magnetization is attained while the resistivity is medium to high, and the charge properties are good and stable when the material is used as the carrier for an electrophotographic developer.

Mg is compatible with a minus toner since the electronegativity of MgO shifts toward the plus side, and thus an MgO-containing Mg ferrite carrier and a full-color toner can compose a developer with good charge rise properties.

Ti in itself is poorly compatible with a minus toner since the electronegativity as $TiO_2$ shifts slightly toward the minus side, but it can minimize such an influence of the chargeability by containing a minus toner carrier in the form of an Fe/Ti compound (oxide) within a range of less than 1.5% by weight.

When an Fe content is below 60% by weight, the amount of Mg and/or Ti to be added relatively increases, accordingly increasing non-magnetic components and/or low magnetized components whereby desired magnetic properties are not rendered. When an Fe content exceeds 70% by weight, the effects of adding Mg and/or Ti are not attained, making the carrier core material substantially equivalent to magnetite. The Mg content is most preferably Mg:divalent Fe=1:1 to 1:4. When an Mg content is below 0.8% by weight, the amount of magnesium ferrite phase produced in the carrier core material is small whereby a coercive force is increased due to the relatively increased production amount of magnetite phase, likely failing to obtain intended magnetic properties. When an Mg content exceeds 5% by weight, the magnesium ferrite is produced in an increased amount in the carrier core material, whereby the intended magnetic properties may not be attained. When a Ti content is below 0.1% by weight, the effect of lowering the sintering temperature provided by the Ti content is not achieved and hence the core material particles having desired surface properties may not be obtained. When a Ti content exceeds 1.5% by weight, the affect on non-magnetic phase by an Fe/Ti compound oxide becomes greater causing the magnetization to be too low, whereby the desired magnetic properties may not be attained. The amount of divalent Fe present can be determined by a crystal structure analysis using powder X-ray diffraction, or by the oxidation reduction titration using potassium permanganate or potassium dichromate in the case of an Mn content is low.

The carrier core material for an electrophotographic developer of the present invention contains 0.2 to 2.5% by weight of Sr. When an Sr content is below 0.2% by weight, the effect of adding Sr cannot be attained and the magnetization tends to be significantly reduced due to the $Fe_2O_3$ generated in association with oxygen concentration changes during the final sintering, hence is not favorable. Further, since the effect of Sr being transferred to the surface of the core material particles during the first and final sinterings cannot be achieved, the effects on raising the resistivity and charge level of the core material cannot be expected. When an Sr content exceeds 2.5% by weight, the material turns to be a hard ferrite, whereby the fluidity of the developer may suddenly be affected on a magnetic brush.

Examples of the oxide crystal structure containing Sr and Fe include Sr ferrites represented by the formulae $SrO.6Fe_2O_3$ or $SrFe_{12}O_{19}$, and may be contained in the carrier core material for an electrophotographic developer of the present invention.

For the carrier core material for an electrophotographic developer of the present invention, Sr must be dissolved at 80 to 1000 ppm with a pH4 standard solution. The amount of dissolution is preferably 80 to 900 ppm, and more preferably 80 to 800 ppm.

An amount of Sr dissolved with a pH4 standard solution less than 80 ppm indicates no Sr is contained and means that the effect of containing Sr cannot be expected. When the amount of Sr dissolved exceeds 1000 ppm, the amount of Sr present on the core material surface is too large causing the core material to have too high resistivity. When such a core material is made into the carrier, the high resistivity causes carrier scattering and image defects. The amount of Sr dissolved with a pH4 standard solution is measured as follows.

(Amount of Sr Dissolved)

50 g of the carrier core material and 50 ml of a pH4 standard solution for pH meter calibration are placed in a 100 ml glass container and stirred for 10 minutes using a paint shaker. After completing the stirring, 2 ml of the supernatant is sampled, pure water is added thereto to dilute the solution to 100 ml, and the diluted solution is measured by ICP. The obtained measured value is multiplied by 50 to determine a value of amount of Sr dissolved. The pH4 standard solution used is specified under JIS Z 8802, Methods for Determination of pH of Aqueous Solutions.

The carrier core material for an electrophotographic developer of the present invention preferably contains Mn, and the Mn content is preferably 0.1 to 10% by weight, more preferably 0.1 to 7% by weight, and most preferably 0.1 to 4% by weight. Mn may intentionally be added, depending on purposes of use, to improve the balance between the resistivity and magnetization. In such a case, the prevention of reoxidation caused when the core material is taken out of the furnace at the final sintering can be expected. Mn, when not intentionally added, but is originally present as an impurity from the raw materials, causes no harm. The form of Mn when added is not limited, but $MnO_2$, $Mn_2O_3$, $Mn_3O_4$ and $MnCO_3$ for industrial use are easily available, hence preferable.

(Contents of Fe, Mg, Ti, Sr and Mn)

The contents of Fe, Mg, Ti, Sr and Mn are measured as follows. 0.2 g of the carrier core material is weighed, and 20 ml of 1 N hydrochloric acid and 20 ml of 1 N nitric acid are added to 60 ml of pure water and heated to prepare an aqueous solution having the carrier core material thoroughly dissolved therein. The Fe, Mg, Ti, Sr and Mn contents are measured using an ICP analyzer (ICPS-10001V, Shimadzu).

The carrier core material for an electrophotographic developer of the present invention contains an oxide crystal structure containing at least Fe and Ti in addition to the spinel structure forming the Mg ferrite. When Ti is added to the Fe-excessive Mg ferrite, a comparatively low magnetized complex oxide containing Fe and Ti is generated within the necessary magnetization range, in addition to the spinel crystal structure compound forming the ordinary ferrite, and the Fe- and Ti-containing complex oxide is oxidized more preferentially than the spinel phase at the time of surface oxidization treatment, whereby the resistivity alone can be controlled without changing the magnetization. In other words, the Fe valence contained in the Fe- and Ti-containing complex oxide adjusts the resistivity as it changes. The crystal structure is measured as follows.

(Crystal Structure Measurement: X-Ray Diffraction Measurement)

PANalytical "X'PertPRO MPD" is used as a measurement apparatus. Using a Co vacuum tube (CoKα ray) as an X-ray source, an intensive optical system as the optical system and a high-speed detection system "X'Celarator", the measurement is carried out by continuously scanning at 0.2°/sec. The measurement results are data processed as in the same manner as the typical powder crystal structure analysis, using an analysis software "X'Pert HighScore" to identify the crystal structure. For the identification of the crystal structure, Fe and O are requisite elements and Mn, Mg, Ti and Sr are the elements which may be contained. For the X-ray source, the Cu vacuum tube can be used for the measurement with no problem, but the Co vacuum tube is preferable since the background is larger than the peak to be measured when a sample contains a large amount of Fe. For the optical system, the parallel method may be capable of obtaining similar results but takes longer time for the measurement due to its low X-ray intensity. For this reason, the intensive optical system is preferably used for the measurement. Further, the rate of continuous scanning is not limited, but, to obtain a sufficient S/N ratio during the crystal structure analysis, the measurement is carried out by setting the carrier core material in a sample cell so that the (311) peak intensity of the spinel structure is about 50000 cps to prevent the particle from orientating to a specific preferential direction.

$MgFe_2O_4$ is a representative spinel structure forming the Mg ferrite. As the element composition ratio shows, Mg is partially replaced by Fe due to the excessive Fe, and $MgFe_2O_4$ formally encompasses all crystal structures represented by $Mg_xFe_{y-x}O_4$, $(Mg_xFe_{1-x})(Mg_{x'}Fe_{1-x'})_2O_4$, etc., those having a part thereof replaced by Mn and/or Sr, and even those periodically containing a lattice defect in the spinel structure from the sintering under a non-oxidative atmosphere.

$FeTiO_3$ and $Fe_2TiO_5$ are the representative oxide crystal structures containing Fe and Ti, wherein the amount of Fe present therein is overwhelmingly greater than that of Ti. In addition to $Fe_xTiO_y$, they encompass the crystal structures represented by $(FeTiO_3)_x(Fe_2O_3)_y$, $Fe(Fe_xTi_y)O_4$, $(Fe_xTi_{1-x})(Fe_{x'}Ti_{1-x'})O_4$, etc., the oxides represented by $Sr_aFe_bTi_cO_d$, etc., wherein a part thereof is replaced by Mn and/or Sr, and even those periodically containing a lattice defect in the above-mentioned crystal structures from the sintering under a non-oxidative atmosphere.

The carrier core material for an electrophotographic developer of the present invention has a charge level of 0.8 to 2 times, preferably 0.8 to 1.9 times, and more preferably 0.9 to 1.9 times, relative to the Mn—Mg ferrite core material. A charge level smaller than 0.8 times causes the core material itself to have a low frictional chargeability. When such a core material is coated with a resin and repeatedly used as a carrier for an electrophotographic developer, the resin film peels off and the chargeability as the carrier is rapidly reduced, whereby image defects and blurs on a printed surface by fogging may occur. A charge level higher than 2 times causes the core material itself to have a too high frictional chargeability. For this reason, when such a core material is coated with a resin and repeatedly used as a carrier for an electrophotographic developer, the resin film peels off and the chargeability as the carrier is rapidly increased, whereby an insufficient image density may result.

(Charge Level Measurement)

3.5 g of a commercial styrene-acrylic negatively charged toner and 46.5 g of the carrier core material are weighed, placed in a 50 ml glass container, and mixed and stirred in a ball mill so as the rotation number to be adjusted to 100. The stirring time is 30 minutes, each developer is exposed for 1 hour under an N/N environment (room temperature 25° C., humidity 55%) and 0.5 g is sampled to measure the charge level using an INSTEC charge measurement apparatus by electric field separation. At this time, an applied voltage is 2000 V and the charge level is a value taken 3 minutes after the initiation of the measurement. Preferable Mn—Mg ferrite core materials as the reference are those containing Mn, Mg and Fe in 40% by mol on the MnO basis, 10% by mol on the MgO basis, and 50% by mol on the $Fe_2O_3$ basis, respectively, and 2% by weight or less of Sr may further be contained. The Mn—Mg ferrite core material as the reference desirably has, at the time of measuring the charge level, a BET specific surface area and an average particle size equivalent to those of the carrier core material for an electrophotographic developer of the present invention. The "equivalent" used herein means a numerical value with less than ±10% difference. When the BET specific surface area and average particle size have a difference greater than ±10%, the charge properties may vary and, needless to say, such a material is not suitable as the reference.

The carrier core material for an electrophotographic developer of the present invention has a true density of 4.5 to 5.3 g/cm$^3$, preferably 4.6 to 5.3 g/cm$^3$, and more preferably 4.7 to 5.2 g/cm$^3$. When a true density is smaller than 4.5 g/cm$^3$, a void is generated in the core material resulting in a deteriorated intensity thereof. When such a material is used as the carrier, it breaks and causes not only image defects such as white spot, etc., but also damages to the photoreceptor. The carrier core material for an electrophotographic developer of the present invention containing Fe as a principle component never has a true density of greater than 5.3 g/cm$^3$.

(Measurement of True Density)

The true densities of the carrier core material and carrier particles after filling are measured in accordance with JIS R9301-2-1, using a picnometer. Methanol is used herein as the solvent, and the measurement is carried out at a temperature of 25° C.

The carrier core material for an electrophotographic developer of the present invention has a BET specific surface area of 0.075 to 0.15 $m^2/g$. When a BET specific surface area is below 0.075 $m^2/g$, the degree of ruggedness on the core material surface is low, failing to provide the anchor effect of the resin after coating the material therewith, whereby the life as the electrophotographic carrier may be shortened. When a BET specific surface area exceeds 0.15 $m^2/g$, the degree of ruggedness on the core material surface is so high that the resin is absorbed too easily whereby the intended properties as the electrophotographic carrier may not be achieved. The BET specific surface area is measured as follows.

(Bet Specific Surface Area)

Using an automatic specific surface area analyzer "GEMINI2360" (product of Shimadzu Corporation), the carrier particle is caused to adsorb $N_2$, an adsorption gas, and an amount of $N_2$ adsorbed by the carrier particle is measured to determined a BET specific surface area. The measurement tube used herein to measure the adsorbed amount of $N_2$ is baked before the measurement at 50° C. for 2 hours under a reduced pressure. Further, the measurement tube is filled with 5 g of the carrier particle, pretreated at 30° C. for 2 hours under a reduced pressure, and subsequently each of the carrier particle is caused to adsorb $N_2$ gas at 25° C., whereby the adsorbed amounts of $N_2$ are measured. The adsorbed amounts are values determined by sketching adsorption isotherm curves, using the BET equation.

The carrier core material for an electrophotographic developer of the present invention desirably has a magnetization of 55 to 85 $Am^2/kg$ when a magnetic field of $3K\cdot1000/4\pi\cdot A/m$ is applied. When a magnetization is below 55 $Am^2/g$ at the above-mentioned $3K\cdot1000/4\pi\cdot A/m$, scattered magnetization is aggravated and image defects may be caused by the carrier beads carry over. A magnetization exceeding 85 $Am^2/g$ causes a bead chain on the magnetic brush developer to be too hard, likely degrading the image quality. The residual magnetization is desirably 2 to 10 $Am^2/kg$. With the composition of the present invention, the residual magnetization is never below 2 $Am^2/kg$ at $3K\cdot1000/4\pi\cdot A/m$ described above. When a residual magnetization exceeds 10 $Am^2/kg$, the fluidity of a developer is deteriorated in a processor, failing to sufficiently stir the developer to impart the frictional charges to the toner. The coercive force is desirably 10 to 80 $3K\cdot1000/4\pi\cdot A/m$ (Oe). With the composition of the present invention, the coercive force is never below 10 $3K\cdot1000/4\pi\cdot A/m$ (Oe). When a coercive force exceeds 80 $3K\cdot1000/4\pi\cdot A/m$ (Oe), the fluidity of a developer is deteriorated in a processor, failing to sufficiently stir the developer to impart the frictional charges to the toner. The magnetization, residual magnetization and coercive force are measured as follows.

(Magnetic Properties)

The measurement is performed using an integral-type B-H tracer BHU-60 (Riken Denshi Co., Ltd.). An H coil for measuring magnetic field and a $4\pi I$ coil for measuring magnetization are place in between electromagnets. In this case, a sample is placed in the $4\pi I$ coil. Outputs of the H coil and the $4\pi I$ coil when the magnetic field H was changed by changing the current of the electromagnets are each integrated, and a hysteresis loop is drawn on a recording chart with the H output as the X-axis and the $4\pi I$ coil output as the Y-axis. The measurement was conducted under the following conditions: the sample filling quantity: about 1 g, the sample filling cell: inner diameter of 7 mmϕ±0.02 mm, height of 10 mm±0.1 mm, and $4\pi I$ coil: winding number of 30.

The carrier core material for an electrophotographic developer of the present invention has an average particle size of preferably 15 to 120 μm, more preferably 15 to 80 μm, and most preferably 15 to 60 μm, when measured using a laser diffraction particle distribution measurement apparatus. A volume average particle size below 15 μm tends to cause the carrier beads carry over, hence not preferable. A volume average particle size exceeding 120 μm tends to degrade the image quality, hence not preferable. The volume average particle size is measured as follows.

(Volume Average Particle Size)

The volume average particle size is measured using a Microtrac Particle Size Analyzer (Model: 9320-X100), manufactured by Nikkiso Co., Ltd. as apparatus. Water is used as a dispersion medium.

The carrier core material for an electrophotographic developer of the present invention desirably has a shape factor SF-2 (circularity) of 100 to 120. The shape factor SF-2 is a numerical value obtained by dividing a value that is a 2-fold magnification of the carrier's projected circumference length with a carrier's projected area, dividing the obtained value with $4\pi$, and further multiplying the thus obtained value by 100. The closer the carrier topography is to sphere, the closer the value is to 100. A shape factor SF-2 of the carrier core material exceeding 120 means a high degree of the ruggedness on the core material surface and makes it too easy for a resin to permeate, whereby the intended properties for the electrophotographic carrier may not be attained. The shape factor SF-2 (circularity) is measured as follows.

(Shape Factor SF-2 (Circularity))

$$SF\text{-}2=L^2/S/4\pi\times100$$

wherein L represents a projected circumference length and S represents a projected area.

The carrier core material for an electrophotographic developer of the present invention desirably has a volume resistivity of $1\times10^6$ to $1\times10^{10}$ Ω·cm at an applied voltage of 50 V. A volume resistivity below $1\times10^6$ Ω·cm causes the resistivity to be too low, whereby a decreased charge may occur. A volume resistivity exceeding $1\times10^{10}$ Ω·cm causes the resistivity to be too high, whereby the charge transfer in association with the frictional charge may be impeded. The method for measuring the volume resistivity will be described later.

The carrier core material for an electrophotographic developer of the present invention is desirably subjected to surface oxidation treatment. The thickness of oxide film formed by the surface treatment is preferably 0.1 nm to 5 μm. A thickness below 0.1 nm does not provide much effect of the oxide film layer, whereas a thickness exceeding 5 μm causes a reduced magnetization and too high resistivity whereby inconveniences such as impaired developing ability, etc., are likely to occur. The reduction may also be carried out as necessary before the oxidization treatment. The thickness of oxide film can be measured by observing an SEM image whose magnification is high enough to identify the formation of oxide film. The oxide film may uniformly be formed throughout the entire core material surface or may partially be formed on the surface.

The volume resistivity of carrier core material subjected to oxidation treatment is desirably $1\times10^6$ to $1\times10^{10}$ Ω·cm at an applied voltage of 50 V, and $6\times10^5$ to $1\times10^{10}$ Ω·cm at an applied voltage of 1000 V. A volume resistivity below $1\times10^6$ Ω·cm at an applied voltage of 50 V causes the resistivity to be too low, whereby a reduced charge may result. A volume resistivity exceeding $1\times10^{10}$ Ω·cm at an applied voltage of 50 V causes the resistivity to be too high, whereby the charge transfer in association with the frictional charge may be impeded. A volume resistivity below $6\times10^5$ Ω·cm at an applied voltage of 1000 V causes the resistivity to be too low, whereby a reduced charge may result. A volume resistivity exceeding $1\times10^{10}$ Ω·cm at an applied voltage of 1000 V causes the resistivity to be too high, whereby the charge transfer in association with the frictional charge may be impeded. The volume resistivity is measured as follows.

(Volume Resistivity)

A sample is filled up to a 4 mm height in a fluororesin cylinder having a cross-sectional area of 4 $cm^2$, an electrode is attached to both ends thereof, and a 1 kg weight is further placed thereon to measure the resistivity. The resistivity measurement is carried out by applying a voltage of 50 V and/or 1000 V, using an insulation resistivity tester, Model6517 type A, a product of Keithley Instruments Inc., and a resistivity is determined based on a current value after 10 seconds (a 10 second current value) to give as a volume resistivity.

The carrier for an electrophotographic developer of the present invention has the above carrier core material covered the surface thereof with a resin.

The carrier for an electrophotographic developer of the present invention desirably contains a resin film volume of 0.1 to 10% by weight, based on the carrier core material. When a film volume is below 0.01% by weight, it is difficult to form a uniform film layer on the carrier surface, whereas when a film volume exceeds 10% by weight, the carrier coagulation occurs causing decreased productivities such as reduced yield, etc., together with changes of developer properties such as fluidity, charge level or the like, in an actual apparatus.

The film forming resin used herein can be suitably selected depending on a toner to be combined therewith, environment to be used, etc. The type of resin is not limited, and examples include fluororesin, acrylate resin, epoxy resin, polyamide resin, polyamide-imide resin, polyester resin, unsaturated polyester resin, urea resin, melamine resin, alkyd resin, phenol resin, fluorine acrylate resin, acrylic-styrene resin, and silicone resin; or modified silicone resins modified with acrylic resin, polyester resin, epoxy resin, polyamide resin, polyamide-imide resin, alkyd resin, urethane resin, fluororesin, or the like. In the present invention, acrylic resin, silicone resin and modified silicone resin are most preferably used.

A conductive agent may also be added to the film forming resin for the purpose of controlling the electrical resistivity, charge level, charging speed of the carrier. Since a conductive agent itself has a low electrical resistivity, a large amount of the addition tends to cause a sudden charge leak. Accordingly, the amount to be added is 0.25 to 20.0% by weight, preferably 0.5 to 15.0% by weight, and especially preferably 1.0 to 10.0% by weight, based on the solid content of the film forming resin. Examples of the conductive agent include conductive carbon, oxides such as titanium oxide or tin oxide, and various organic conductive agents.

A charge control agent may further be contained in the film forming resins described above. Examples of the charge control agent include various charge control agents typically used for toners and various silane coupling agents. This is because the addition of various charge control agents and silane coupling agents can control the reduced charge imparting capability, which is sometimes caused as a result of forming the film to make the core material exposed area comparatively small. The usable charge control agents and coupling agents are not limited, and preferable examples include nigrosin dye, quaternary ammonium salt, organic metal complex, metal-containing monoazo dye, or like charge control agents; aminosilane coupling agent, fluorinated silane coupling agent, etc. The method for measuring a charge level is as described above.

<Method for Producing the Carrier Core Material and Carrier for an Electrophotographic Developer of the Present Invention>

Hereinafter, the method for producing the carrier core material and the carrier for an electrophotographic developer of the present invention is described.

The process for producing the carrier core material for an electrophotographic developer of the present invention comprises crushing, mixing, calcining and subsequently granulating each compound of Fe, Ti, Mg and Sr, subjecting the obtained granulated products to the first sintering and final sintering, and further crushing, classifying and subjecting the products to surface oxidation treatment.

The method for crushing, mixing and granulating each compound of Fe, Ti, Mg and Sr to prepare the granulated products is not limited, and the conventionally known techniques may be employed including the dry process and the wet process. As raw materials $Fe_2O_3$, $TiO_2$, $Mg(OH)_2$ and/or $MgCO_3$ and $SrCO_3$ are mixed together, carbon black and/or a binder is further added thereto, and the mixture is sintered under a non-oxidative atmosphere or weak reductive atmosphere to produce a ferrite precursor state wherein at least the spinel phase containing a divalent Fe and a complex oxide phase containing Fe and Ti are present. MnO is added as necessary as a raw material. In the conventional production process, a considerable amount of energy is required for changing the crystal structure to produce the spinel phase from $Fe_2O_3$ during the final sintering. However, in the case of mixing $Fe_2O_3$, $TiO_2$, $Mg(OH)_2$ and/or $MgCO_3$ and $SrCO_3$ in advance and further adding carbon black and/or a binder followed by the calcination, only the bare minimum crystal structure change is required during the final sintering to complete the ferritization, thereby enabling a low temperature sintering. Polyvinyl alcohol and polyvinyl pyrrolidone are preferably used as a binder.

In the production process of the present invention, the obtained granulated products are subjected to the first sintering and final sintering. The first sintering is carried out at 500 to 1100° C. under a non-oxidative atmosphere.

Subsequently, the final sintering is carried out at a temperature equal to or lower than 1280° C. The final sintering is expected to provide the effects in making the crystal structure stable and preventing the magnetization to be reduced by the surface oxidization. Unlike the process wherein the first sintering is not performed, the final sintering can be carried out at a lower temperature when the first sintering is performed, easily ensuring rugged core material particles and high degree of sphericity.

In the production process of the present invention, the final sintering can be carried out at a temperature equal to or lower than 1280° C., a lower temperature than that required in a conventional process, because, as described above, the ferrite precursor contains not only the crystal structures of raw materials at the time of granulating the core material particles prior to the final sintering but also the spinel phase containing at least a divalent Fe and the complex oxide phase containing Fe and Ti; and further the first sintering is carried out at 500 to 1100° C. under a non-oxidative atmosphere whereby the ferritization is facilitated without the hematite.

According to the production process of the present invention, the final sintering is carried out at an oxygen concentration less than 5% by volume. When an oxygen concentration exceeds 5% by volume, the magnetization of a sintered product becomes too low causing carrier scattering, thus not preferable. To obtain a carrier core material having high magnetization, an oxygen concentration less than 3% by volume is preferable, and less than 1% by volume is even more preferable.

Subsequently, the resultant sintered material is collected, dried and classified to obtain the carrier core material. The carrier core material is adjusted to the intended particle size using a classification method such as air classification, mesh filtration technique, sedimentation method, or like conventional methods. A dry type collection, if performed, can be done using cyclone, or the like.

Then, the electric resistance can optionally be adjusted by heating the surface at a low temperature to carry out an oxide film treatment. The oxide film treatment is carried out using a common furnace such as a rotary electric furnace or batch-type electric furnace, and the heat treatment is carried out, for example, at 300 to 800° C. It is preferable to use a rotary electric furnace to uniformly form an oxide film on the core material particles.

The career for an electrophotographic developer of the present invention has the above-mentioned carrier core material coated the surface thereof with the resin described above to form a resin film thereon. The coating can be performed by a conventional technique including, for examples, brush coating method, spray-dry method using a fluidized bed, rotary-dry method, dip-and-dry method using a universal stirrer, etc. To enhance the coating efficiency, the method using a fluidized bed is preferable.

The baking, if performed after coating the resin on the carrier core material, may be done by using external heating or internal heating, including, for example, a fixed-type or fluidized electric furnace, rotary electric furnace, burner furnace, or the baking may even be carried out by using microwaves. In the case of using a UV curable resin, a UV heater is used. The baking temperature may vary depending on resins to be used, but must be not lower than the melting point or the glass transition temperature. For a thermosetting resin, condensation-crosslinking resin or the like, the temperature is required to be raised to a temperature where curing fully progresses.

<The Electrographic Developer of the Present Invention>

Next, the electrographic developer of the present invention is described.

The electrophotographic developer of the present invention is composed of the carrier and toner for an electrophotographic developer described above.

The toner particle constituting the electrophotographic developer of the present invention includes pulverized toner particle produced by pulverization and polymerized toner particle produced by polymerization. In the present invention, the toner particle obtained by either of the methods can be used.

The pulverized toner particles are obtained by fully mixing, for example, a binding resin, a charge control agent and a colorant in a mixer such as a Henschel mixer, then melting and kneading by a biaxial extruder, etc., cooling, and thereafter pulverizing, classifying, adding external additives, and mixing them using a mixer, etc.

The binding resin constituting the pulverized toner particles is not limited, and includes polystyrene, chloropolystyrene, styrene-chlorostyrene copolymer, styrene-acrylate copolymer, styrene-methacrylate copolymer, and further rosin-modified maleic acid resin, epoxy resin, polyester resin and polyurethane resin, etc. These are used singly or in a mixture thereof.

As the charge control agent, any agent can be used. Examples include positively chargeable toners such as nigrosin dye, quaternary ammonium salt, etc., and negatively chargeable toners such as metal-containing monoazo dye, etc.

As the colorant (coloring material), conventionally known dyes and pigments are usable. Usable examples include carbon black, phthalocyanine blue, permanent red, chrome yellow, phthalocyanine green and the like. In addition, external additives, such as silica powder and titania for improving the fluidity and cohesion resistance of the toner, can be added depending on the toner particles used.

The polymerized toner particles are those produced by a conventionally known method such as suspension polymerization, emulsion polymerization, emulsion aggregation, ester extension polymerization and phase transition emulsion. Such toner particles from polymerization are obtained, for example, as follows. A colored dispersion liquid in which a colorant is dispersed in water using a surfactant, a polymerizable monomer, a surfactant and a polymerization initiator are mixed and stirred in an aqueous medium to emulsify, disperse and polymerize the polymerizable monomer in the aqueous medium while stirring and mixing; thereafter, the polymerized dispersion is loaded with a salting-out agent to salt out the polymerized particles. The particles obtained by the salting-out are filtered, washed and dried to obtain the polymerized toner particles. Thereafter, the dried toner particles are optionally loaded with external additives to impart properties.

Further, in producing the polymerized toner particles, a fixability improving agent and a charge control agent can be admixed in addition to the polymerizable monomer, surfactant, polymerization initiator and colorant, thus allowing to control and improve various properties of the polymerized toner particles obtained using them. In addition, a chain-transfer agent can be used to improve the dispersibility of the polymerizable monomer in the aqueous medium, and adjust the molecular weight of the obtained polymer.

The polymerizable monomer used for the production of the above polymerized toner particles is not limited, and examples include styrene and derivatives thereof, ethylenically unsaturated monoolefins such as ethylene and propylene, halogenated vinyls such as vinyl chloride, vinyl esters such as vinyl acetate, and α-methylene aliphatic monocarboxylates such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used for preparing the polymerized toner particles described above, conventionally known dyes and pigments are usable. Carbon black, phthalocyanine blue, permanent red, chrome yellow and phthalocyanine green, etc., can be used. The surface of colorants may be improved by using a silane coupling agent, a titanium coupling agent, etc.

As the surfactant used for the production of the polymerized toner particles described above, an anionic surfactant, a cationic surfactant, an amphoteric surfactant and a nonionic surfactant can be used.

The anionic surfactants herein include sodium oleate, a fatty acid salt such as castor oil, an alkyl sulfate ester such as sodium lauryl sulfate and ammonium lauryl sulfate, an alkylbenzenesulfonate such as sodium dodecylbenzenesulfonate, an alkylnaphthalenesulfonate, an alkyl phosphate ester salt, a naphthalenesulfonic acid-formalin condensate, a polyoxyethylene alkylsulfate ester salt, etc. The nonionic surfactants include a polyoxyethylene alkyl ether, a polyoxyethylene aliphatic acid ester, a sorbitan aliphatic acid ester, a polyoxyethylene alkyl amine, glycerin, an aliphatic acid ester, an oxyethylene-oxypropylene blockpolymer, etc. Further, the cationic surfactants include an alkylamine salt such as laurylamine acetate, and a quaternary ammonium salt such as lauryltrimethylammonium chloride, stearyltrimethylammonium chloride, etc. Then, the amphoteric surfactants include an aminocarboxylate, an alkylamino acid, etc.

The surfactant as described above is generally used in an amount within the range of 0.01 to 10% by weight to a polymerizable monomer. Such a surfactant affects the dispersion stability of the monomer and also affects the environmental dependency of the obtained polymerized toner particles. For this reason, it is preferable to use the surfactant in an amount within the above range to ensure the dispersion stability of the monomer and reduce the environmental dependency of the polymerized toner particles.

To produce the polymerized toner particles, a polymerization initiator is usually used. The polymerization initiators come in a water-soluble polymerization initiator and an oil-soluble polymerization initiator, and either of them can be used in the present invention. The water-soluble polymerization initiator used in the present invention includes, for example, peroxosulfates such as potassium peroxosulfate, ammonium peroxosulfate, etc., water-soluble peroxide compounds, etc. The oil-soluble polymerization initiator includes, for example, azo compounds such as azobisisobutyronitrile, etc., oil-soluble peroxide compounds, etc.

In the case of using a chain-transfer agent in the present invention, examples include mercaptans such as octylmercaptan, dodecylmercaptan, tert-dodecylmercaptan, etc., carbon tetrabromide, etc.

Further, when the polymerized toner particles used in the present invention contain a fixability improving agent, examples of the usable fixability improving agent include natural waxes such as carnauba wax, olefinic waxes such as polypropylene, polyethylene, etc.

Furthermore, when the polymerized toner particles used in the present invention contain a charge control agent, usable charge control agents is not limited and examples include nigrosine dyes, quaternary ammonium salts, organic metal complexes, metal-containing monoazo dyes, etc.

An external additive used for improving the fluidity etc. of the polymerized toner particles includes silica, titanium oxide, barium titanate, fluororesin microparticles, acrylic resin microparticles, etc., and these can be used singly or in a combination.

Further, the salting-out agent used for separating polymerized particles from an aqueous medium includes metal salts such as magnesium sulfate, aluminum sulfate, barium chloride, magnesium chloride, calcium chloride, sodium chloride, etc.

The volume average particle size of the toner particles produced as described above is in the range of 2 to 15 μm, and preferably 3 to 10 μm. The polymerized toner particles have a higher uniformity than the pulverized toner particles. The toner particles of less than 2 μm decrease the chargeability and are liable to cause the fogging of image and toner scattering. Those exceeding 15 μm cause the degradation of image quality.

By mixing the carrier and the toner produced as described above, an electrophotographic developer can be obtained. The mixing ratio of the carrier to the toner, namely, the toner concentration, is preferably set to be 3 to 15% by weight. With a toner concentration below 3% by weight, a desired image density is hard to obtain. With that exceeding 15% by weight, the toner scattering and fogging of image are likely to occur.

The electrophotographic developer of the present invention is also used as a replenishing developer. The mixing ratio of the carrier to the toner, namely, the toner concentration, is preferably set to be 100 to 3000% by weight.

The electrophotographic developer of the present invention prepared as described above can be used in copying machines, printers, FAXs, printing presses and the like, in the digital system, which use the development system in which electrostatic latent images formed on a latent image holder having an organic photoconductor layer are reversal-developed by magnetic brushes of the two-component developer having the toner and carrier while impressing a bias electric field. It is also applicable to full-color machines and the like which use an alternating electric field, which is a method to superimpose an AC bias on a DC bias when the developing bias is applied from magnetic brushes to the electrostatic latent image side.

The present invention is described hereinafter with reference to Examples and the like.

EXAMPLE 1

$Fe_2O_3$, $Mg(OH)_2$, $TiO_2$, $SrCO_3$ and $Mn_3O_4$ were each weighed so as to be 6.872 mol of Fe, 0.64 mol of Mg, 0.125 mol of Ti, 0.075 mol of Sr and 0.075 mol of Mn, added with water to give a solid content of 50% by weight, and mixed using a bead mill. The mixed slurry was granulated using a spray drier. At this step, PVA as a binder component was added so as to be 2% by weight of the solid content and a polycarboxylate dispersant so as a viscosity of the slurry to be 1 to 2 poise, and the obtained granulated resultant was calcined in a rotary calcining furnace at 1050° C. under a non-oxidative atmosphere, whereby the iron oxide was partially reduced while simultaneously proceeding the ferritization as removing the organic compounds. The calcined product had a magnetization of 48 $Am^2/kg$ at this time.

The obtained calcined product was crushed using a bead mill so that $D_{50}$ of the slurry particle size is 2 μm. At this step, PVA as a binder component was added so as to be 0.15% by weight of the solid content and a polycarboxylate dispersant so as a viscosity of the slurry to be 2 to 3 poise, and the obtained crushed slurry was granulated again using a spray drier, subjected to the first sintering in a rotary sintering furnace at 950° C. under a non-oxidative atmosphere, whereby the iron oxide was partially reduced while simultaneously proceeding the ferritization as removing the organic compounds. The product after the first sintering had a magnetization of 68 $Am^2/kg$.

The product subjected to the first sintering was sieved using an 80 mesh to remove coarse particles, and sintered at 1180° C. for 16 hours under a condition of an oxygen concentration of 0% by weight, thereby obtaining the sintered product. The obtained sintered product was crushed, classified and magnetically dressed, thereby obtaining the carrier core material particles having a volume average particle size of 36.71 μm. The carrier core material particle had a magnetization of 72 $Am^2/kg$. The crystal structure of the obtained carrier core material particles was observed using an X-ray diffraction apparatus, and found that the oxide crystal structure containing Fe and Ti was present in addition to the spinel crystal structure containing Mg.

The obtained carrier core material particles were subjected to surface oxidation treatment in a rotary electric furnace under the conditions of a surface oxidization temperature of 680° C. in an ambient atmosphere, thereby obtaining the surface oxidized carrier core material particles. The carrier core material particles subjected to surface oxidation treatment had a volume average particle size of 37.71 μm and a magnetization of 67 $Am^2/kg$.

EXAMPLE 2

The carrier core material particle having a volume average particle size of 39.14 μm was obtained in the same manner as in Example 1, except that 6.724 mol of Fe, 0.25 mol of Mg and 0.4 mol of Mn were used.

EXAMPLE 3

The carrier core material particle having a volume average particle size of 39.13 μm was obtained in the same manner as in Example 2, except that 1 mol of Mg was used.

EXAMPLE 4

The carrier core material particle having a volume average particle size of 38.12 μm was obtained in the same manner as in Example 2, except that 6.722 mol of Fe, 0.64 mol of Mg and 0.025 mol of Ti were used.

EXAMPLE 5

The carrier core material particle having a volume average particle size of 38.59 μm was obtained in the same manner as in Example 2, except that 0.64 mol of Mg and 0.16 mol of Ti were used.

EXAMPLE 6

The carrier core material particle having a volume average particle size of 38.78 μm was obtained in the same manner as in Example 2, except that 6.722 mol of Fe, 0.64 mol of Mg and 0.015 mol of Sr were used.

EXAMPLE 7

The carrier core material particle having a volume average particle size of 39.68 μm was obtained in the same manner as in Example 2, except that 0.64 mol of Mg and 0.125 mol of Sr were used.

EXAMPLE 8

The carrier core material particle having a volume average particle size of 37.96 μm was obtained in the same manner as in Example 2, except that 7.122 mol of Fe, 0.64 mol of Mg and 0 mol of Mn were used.

EXAMPLE 9

The carrier core material particle having a volume average particle size of 37.2 μm was obtained in the same manner as in Example 2, except that 0.64 mol of Mg was used.

EXAMPLE 10

The carrier core material particle having a volume average particle size of 39.08 μm was obtained in the same manner as in Example 2, except that 0.55 mol of Mg was used and the final sintering was carried out at 1170° C.

EXAMPLE 11

The carrier core material particle having a volume average particle size of 38.67 μm was obtained in the same manner as in Example 2, except that 0.55 mol of Mg was used and the final sintering was carried out at 1220° C.

COMPARATIVE EXAMPLE 1

The carrier core material particle having a volume average particle size of 38.61 μm was obtained in the same manner as in Example 2, except that 0 mol of Mg was used.

COMPARATIVE EXAMPLE 2

The carrier core material particle having a volume average particle size of 39.9 μm was obtained in the same manner as in Example 2, except that 1.765 mol of Mg was used.

COMPARATIVE EXAMPLE 3

The carrier core material particle having a volume average particle size of 38.64 μm was obtained in the same manner as in Example 2, except that 6.722 mol of Fe, 0.64 mol of Mg and 0 mol of Ti were used.

COMPARATIVE EXAMPLE 4

The carrier core material particle having a volume average particle size of 37.53 μm was obtained in the same manner as in Example 2, except that 0.64 mol of Mg and 0.325 mol of Ti were used.

COMPARATIVE EXAMPLE 5

The carrier core material particle having a volume average particle size of 39.36 μm was obtained in the same manner as in Example 2, except that 0.64 mol of Mg and 0.225 mol of Sr were used.

COMPARATIVE EXAMPLE 6

The carrier core material particle having a volume average particle size of 39.11 μm was obtained in the same manner as in Example 2, except that 5.924 mol of Fe, 0.64 mol of Mg and 1.2 mol of Mn were used.

COMPARATIVE EXAMPLE 7

The carrier core material particle having a volume average particle size of 38.8 μm was obtained in the same manner as in Example 2, except that 0.64 mol of Mg and 0.075 mol of Mn were used and the final sintering was carried out at 1150° C.

COMPARATIVE EXAMPLE 8

The carrier core material particle having a volume average particle size of 38.88 μm was obtained in the same manner as in Example 2, except that 0.64 mol of Mg and 0.075 mol of Mn were used and the final sintering was carried out at 1250° C.

In regard to Examples 1 to 11 and Comparative Examples 1 to 8, Table 1 shows the production conditions of the carrier core materials, Tables 2 and 3 show the volume average particle size, BET specific surface area, resistivity, magnetic properties, chemical analysis, true density, charge level of the core material (comparisons with Mn—Mg—Sr core material), X-ray diffraction and pH dissolution (ICP) before the surface oxidation treatment, and Table 4 shows the surface oxidation treatment temperature, and magnetic properties, average particle size, BET specific surface area, shape factor (SF-2) and resistivity after the surface oxidation treatment. The measurement methods are as described above.

TABLE 1

| | Amount loaded (mol) | | | | | Calcination | | Final granulation Slurry particle size | First sintering | | Final sintering | |
|---|---|---|---|---|---|---|---|---|---|---|---|---|
| | Fe | Mg | Ti | Sr | Mn | Atmosphere | Sintering temperature | | Atmosphere | Sintering temperature | Atmosphere | Sintering temperature |
| Example 1 | 6.872 | 0.64 | 0.125 | 0.075 | 0.075 | 0 vol % | 1050° C. | 2 μm | 0 vol % | 950° C. | 0 vol % | 1180° C. |
| Example 2 | 6.724 | 0.25 | 0.125 | 0.075 | 0.4 | 0 vol % | 1050° C. | 2 μm | 0 vol % | 950° C. | 0 vol % | 1180° C. |
| Example 3 | 6.724 | 1 | 0.125 | 0.075 | 0.4 | 0 vol % | 1050° C. | 2 μm | 0 vol % | 950° C. | 0 vol % | 1180° C. |
| Example 4 | 6.722 | 0.64 | 0.025 | 0.075 | 0.4 | 0 vol % | 1050° C. | 2 μm | 0 vol % | 950° C. | 0 vol % | 1180° C. |
| Example 5 | 6.724 | 0.64 | 0.16 | 0.075 | 0.4 | 0 vol % | 1050° C. | 2 μm | 0 vol % | 950° C. | 0 vol % | 1180° C. |
| Example 6 | 6.722 | 0.64 | 0.125 | 0.015 | 0.4 | 0 vol % | 1050° C. | 2 μm | 0 vol % | 950° C. | 0 vol % | 1180° C. |
| Example 7 | 6.724 | 0.64 | 0.125 | 0.125 | 0.4 | 0 vol % | 1050° C. | 2 μm | 0 vol % | 950° C. | 0 vol % | 1180° C. |
| Example 8 | 7.122 | 0.64 | 0.125 | 0.075 | 0 | 0 vol % | 1050° C. | 2 μm | 0 vol % | 950° C. | 0 vol % | 1180° C. |
| Example 9 | 6.724 | 0.64 | 0.125 | 0.075 | 0.4 | 0 vol % | 1050° C. | 2 μm | 0 vol % | 950° C. | 0 vol % | 1180° C. |
| Example 10 | 6.724 | 0.55 | 0.125 | 0.075 | 0.4 | 0 vol % | 1050° C. | 2 μm | 0 vol % | 950° C. | 0 vol % | 1170° C. |
| Example 11 | 6.724 | 0.55 | 0.125 | 0.075 | 0.4 | 0 vol % | 1050° C. | 2 μm | 0 vol % | 950° C. | 0 vol % | 1220° C. |
| Comparative Example 1 | 6.724 | 0 | 0.125 | 0.075 | 0.4 | 0 vol % | 1050° C. | 2 μm | 0 vol % | 950° C. | 0 vol % | 1180° C. |
| Comparative Example 2 | 6.724 | 1.765 | 0.125 | 0.075 | 0.4 | 0 vol % | 1050° C. | 2 μm | 0 vol % | 950° C. | 0 vol % | 1180° C. |
| Comparative Example 3 | 6.722 | 0.64 | 0 | 0.075 | 0.4 | 0 vol % | 1050° C. | 2 μm | 0 vol % | 950° C. | 0 vol % | 1180° C. |
| Comparative Example 4 | 6.724 | 0.64 | 0.325 | 0.075 | 0.4 | 0 vol % | 1050° C. | 2 μm | 0 vol % | 950° C. | 0 vol % | 1180° C. |
| Comparative Example 5 | 6.724 | 0.64 | 0.125 | 0.225 | 0.4 | 0 vol % | 1050° C. | 2 μm | 0 vol % | 950° C. | 0 vol % | 1180° C. |
| Comparative Example 6 | 5.924 | 0.64 | 0.125 | 0.075 | 1.2 | 0 vol % | 1050° C. | 2 μm | 0 vol % | 950° C. | 0 vol % | 1180° C. |
| Comparative Example 7 | 6.724 | 0.64 | 0.125 | 0.075 | 0.075 | 0 vol % | 1050° C. | 2 μm | 0 vol % | 950° C. | 0 vol % | 1150° C. |
| Comparative Example 8 | 6.724 | 0.64 | 0.125 | 0.075 | 0.075 | 0 vol % | 1050° C. | 2 μm | 0 vol % | 950° C. | 0 vol % | 1250° C. |

TABLE 2

| | Average particle size (μm) | BET specific surface area ($m^2/g$) | Magnetic property: Magnetization ($Am^2/kg$) | Magnetic property: Residual magnetization ($Am^2/kg$) | Magnetic property: Coercive force (Oe) | Chemical analysis (ICP) (wt. %): Fe | Mg | Ti | Sr | Mn | True density ($g/cm^3$) | Charge level of core material (compared to Mn—Mg—Sr core material) |
|---|---|---|---|---|---|---|---|---|---|---|---|---|
| Example 1 | 36.71 | 0.1032 | 72 | 4 | 24 | 65.57 | 2.49 | 1 | 1.095 | 0.69 | 5.11 | 1.22 |
| Example 2 | 38.13 | 0.1121 | 74 | 4 | 24 | 64.43 | 0.98 | 1 | 1.103 | 3.69 | 5.04 | 1.06 |
| Example 3 | 38.09 | 0.0987 | 70 | 3 | 18 | 60.72 | 3.78 | 0.97 | 1.063 | 3.55 | 5.02 | 1.28 |
| Example 4 | 37.11 | 0.0957 | 76 | 3 | 12 | 63.27 | 2.52 | 0.2 | 1.108 | 3.7 | 5.05 | 1.2 |
| Example 5 | 37.51 | 0.1099 | 68 | 5 | 36 | 62.07 | 2.48 | 1.24 | 1.086 | 3.63 | 5.00 | 1.16 |
| Example 6 | 37.81 | 0.0897 | 77 | 3 | 12 | 63.23 | 2.52 | 1.01 | 0.221 | 3.7 | 5.05 | 1.02 |
| Example 7 | 38.33 | 0.1254 | 69 | 6 | 60 | 61.68 | 2.46 | 0.98 | 1.799 | 3.61 | 5.01 | 1.54 |
| Example 8 | 36.98 | 0.1122 | 72 | 3 | 18 | 66.3 | 2.5 | 1 | 1.095 | 0.13 | 5.13 | 1.17 |
| Example 9 | 36.24 | 0.0966 | 74 | 2 | 12 | 62.37 | 2.49 | 0.99 | 1.092 | 3.65 | 5.03 | 1.23 |
| Example 10 | 38.01 | 0.1356 | 63 | 4 | 24 | 62.65 | 2.11 | 0.97 | 1.069 | 3.52 | 4.83 | 0.91 |
| Example 11 | 37.61 | 0.0821 | 75 | 3 | 24 | 62.83 | 2.05 | 1.02 | 1.122 | 3.69 | 5.04 | 1.87 |
| Comparative Example 1 | 37.63 | 0.1512 | 87 | 4 | 24 | 65.55 | 0.01 | 1.04 | 1.147 | 3.83 | 5.11 | 0.79 |
| Comparative Example 2 | 38.91 | 0.1105 | 53 | 5 | 30 | 57.48 | 6.32 | 0.92 | 1.006 | 3.36 | 4.89 | 1.34 |
| Comparative Example 3 | 37.62 | 0.1077 | 86 | 3 | 18 | 63.5 | 2.53 | 0 | 1.111 | 3.71 | 5.06 | 0.85 |
| Comparative Example 4 | 36.59 | 0.1254 | 54 | 8 | 108 | 60.66 | 2.42 | 2.51 | 1.061 | 3.55 | 4.98 | 1.26 |
| Comparative Example 5 | 38.32 | 0.1569 | 63 | 8 | 90 | 60.34 | 2.41 | 0.96 | 3.168 | 3.53 | 4.97 | 2.03 |
| Comparative Example 6 | 38.13 | 0.0963 | 72 | 1 | 10 | 54.59 | 2.47 | 0.99 | 1.084 | 10.87 | 4.81 | 1.24 |
| Comparative Example 7 | 37.78 | 0.1781 | 69 | 3 | 24 | 62.72 | 2.19 | 0.99 | 1.087 | 3.61 | 4.78 | 0.76 |
| Comparative Example 8 | 37.81 | 0.0739 | 76 | 2 | 12 | 62.81 | 2.21 | 1.03 | 1.091 | 3.81 | 5.04 | 2.01 |

TABLE 3

| | X-ray diffraction analysis | | | | | Resistivity (before surface oxidation treatment) (Ω · cm) | pH 4 dissolution (ICP) (ppm) | | | | |
|---|---|---|---|---|---|---|---|---|---|---|---|
| | $Fe_3O_4/MgFe_2O_4$ (Spinel) | FeO | $Fe_2O_3$ | Fe—Ti Compound | Sr-Ferrite | 50 V | Fe | Mg | Ti | Sr | Mn |
| Example 1 | ○ | Δ | X | ○ ($SrFe_{0.5}Ti_{0.5}O_{2.75}$) | X | $2.8 \times 10^8$ | 4 | 7 | 2 | 283 | 5 |
| Example 2 | ○ | ○ | X | ○ ($SrFe_{0.5}Ti_{0.5}O_{2.85}$) | X | $3.5 \times 10^7$ | 3 | 3 | 1 | 301 | 10 |
| Example 3 | ○ | Δ | X | ○ ($SrFe_{0.5}Ti_{0.5}O_{2.85}$) | X | $6.6 \times 10^8$ | 5 | 18 | <1 | 292 | 12 |
| Example 4 | ○ | Δ | X | ○ ($SrFe_{0.5}Ti_{0.5}O_{2.85}$) | X | $5.5 \times 10^6$ | 5 | 9 | <1 | 259 | 8 |
| Example 5 | ○ | Δ | X | ○ ($SrFe_{0.5}Ti_{0.5}O_{2.85}$) | X | $4.7 \times 10^9$ | 4 | 8 | 6 | 311 | 9 |
| Example 6 | ○ | Δ | X | ○ ($SrFe_{0.5}Ti_{0.5}O_{2.85}$) | X | $2.2 \times 10^7$ | 6 | 11 | 4 | 82 | 7 |
| Example 7 | ○ | Δ | X | ○ ($SrFe_{0.5}Ti_{0.5}O_{2.85}$) | Δ | $6.9 \times 10^9$ | 3 | 9 | 2 | 776 | 8 |
| Example 8 | ○ | Δ | X | ○ ($SrFe_{0.5}Ti_{0.5}O_{2.85}$) | X | $5.3 \times 10^8$ | 4 | 13 | 4 | 267 | 1 |
| Example 9 | ○ | Δ | X | ○ ($SrFe_{0.5}Ti_{0.5}O_{2.85}$) | X | $4.2 \times 10^8$ | 5 | 10 | 3 | 238 | 18 |
| Example 10 | ○ | Δ | X | ○ ($SrFe_{0.5}Ti_{0.5}O_{2.85}$) | X | $8.6 \times 10^7$ | 3 | 20 | 5 | 589 | 21 |
| Example 11 | ○ | ○ | X | ○ ($SrFe_{0.5}Ti_{0.5}O_{2.75}$) | Δ | $6.1 \times 10^8$ | 2 | 1 | 4 | 111 | 2 |
| Comparative Example 1 | ○ | Δ | Δ | ○ ($SrFe_{0.5}Ti_{0.5}O_{2.85}$) | X | Not measurable (low resistivity) | 5 | <1 | 3 | 296 | 11 |
| Comparative Example 2 | ○ | X | X | ○ ($SrFe_{0.5}Ti_{0.5}O_{2.85}$) | Δ | $3.1 \times 10^9$ | 4 | 35 | 2 | 331 | 9 |
| Comparative Example 3 | ○ | Δ | Δ | ○ ($Sr_2Fe_2O_5$) | X | $1.5 \times 10^7$ | 6 | 11 | <1 | 248 | 8 |
| Comparative Example 4 | ○ | Δ | X | ○ ($SrFe_{0.5}Ti_{0.5}O_{2.85}$) | X | $9.1 \times 10^8$ | 5 | 16 | 12 | 255 | 10 |
| Comparative Example 5 | ○ | Δ | X | ○ ($SrFe_{0.5}Ti_{0.5}O_{2.85}$) | Δ | $1.3 \times 10^{10}$ | 3 | 18 | 1 | 1075 | 14 |
| Comparative Example 6 | ○ | Δ | X | ○ ($SrFe_{0.5}Ti_{0.5}O_{2.85}$) | X | $7.1 \times 10^8$ | 4 | 6 | 1 | 328 | 56 |
| Comparative Example 7 | ○ | ○ | Δ | ○ ($SrFe_{0.5}Ti_{0.5}O_{2.85}$) | X | $3.9 \times 10^8$ | 5 | 35 | 6 | 1017 | 36 |
| Comparative Example 8 | ○ | Δ | ○ | ○ ($SrFe_{0.5}Ti_{0.5}O_{2.85}$) | Δ | $5.1 \times 10^8$ | 5 | <1 | <1 | 75 | 1 |

○: Crystal structure is found present

Δ: A small amount of crystal structure is found present

X: No crystal structure is found

TABLE 4

| | Surface oxidation treatment Treatment temperature ° C. | Magnetic property: Magnetization ($Am^2/kg$) | Residual magnetization ($Am^2/kg$) | Coercive force (Oe) | Average particle size (μm) | BET specific surface area ($m^2/g$) | Shape factor (SF-2) | Resistivity (after surface oxidation treatment) (Ω · cm): 50 V | 1000 V |
|---|---|---|---|---|---|---|---|---|---|
| Example 1 | 680 | 67 | 5 | 36 | 37.71 | 0.1119 | 108 | $5.8 \times 10^8$ | $3.2 \times 10^6$ |
| Example 2 | 680 | 62 | 6 | 36 | 39.14 | 0.121 | 110 | $6.2 \times 10^7$ | $9.8 \times 10^6$ |
| Example 3 | 680 | 67 | 5 | 24 | 39.13 | 0.1061 | 107 | $7.9 \times 10^8$ | $4.3 \times 10^7$ |
| Example 4 | 680 | 61 | 6 | 40 | 38.12 | 0.1031 | 109 | $3.8 \times 10^7$ | $1.1 \times 10^6$ |
| Example 5 | 680 | 64 | 7 | 48 | 38.59 | 0.1192 | 104 | $7.4 \times 10^9$ | $8.2 \times 10^6$ |
| Example 6 | 680 | 72 | 5 | 36 | 38.78 | 0.0975 | 106 | $9.8 \times 10^7$ | $1.6 \times 10^6$ |
| Example 7 | 680 | 64 | 9 | 72 | 39.68 | 0.1358 | 112 | $7.8 \times 10^9$ | $9.1 \times 10^7$ |
| Example 8 | 680 | 60 | 5 | 30 | 37.96 | 0.1276 | 111 | $6.1 \times 10^8$ | $5.1 \times 10^6$ |
| Example 9 | 680 | 70 | 4 | 24 | 37.2 | 0.1048 | 107 | $7.2 \times 10^8$ | $2.3 \times 10^7$ |
| Example 10 | 680 | 58 | 7 | 60 | 39.08 | 0.1464 | 105 | $1.1 \times 10^8$ | $6.6 \times 10^7$ |
| Example 11 | 680 | 71 | 5 | 48 | 38.67 | 0.0881 | 114 | $9.5 \times 10^8$ | $7.1 \times 10^7$ |
| Comparative Example 1 | 680 | 58 | 7 | 42 | 38.61 | 0.1639 | 113 | $4.9 \times 10^6$ | Not measurable (low resistivity) |
| Comparative Example 2 | 680 | 49 | 6 | 36 | 39.9 | 0.1191 | 108 | $4.3 \times 10^9$ | $3.1 \times 10^7$ |
| Comparative Example 3 | 680 | 54 | 4 | 24 | 38.64 | 0.116 | 109 | $3.8 \times 10^7$ | Not measurable (low resistivity) |
| Comparative Example 4 | 680 | 52 | 11 | 132 | 37.53 | 0.1352 | 107 | $2.1 \times 10^9$ | $5.6 \times 10^8$ |
| Comparative Example 5 | 680 | 58 | 10 | 120 | 39.36 | 0.1704 | 131 | $3.1 \times 10^{11}$ | $2.8 \times 10^9$ |
| Comparative Example 6 | 680 | 69 | 1 | 10 | 39.11 | 0.1063 | 107 | $8.8 \times 10^8$ | $6.1 \times 10^6$ |
| Comparative Example 7 | 680 | 58 | 6 | 42 | 38.8 | 0.1925 | 121 | $5.3 \times 10^8$ | $9.8 \times 10^6$ |
| Comparative Example 8 | 680 | 72 | 4 | 24 | 38.88 | 0.0809 | 127 | $7.9 \times 10^8$ | $4.9 \times 10^6$ |

As revealed from the results in Tables 1 to 4, sufficient property values are ensured in Examples 1 to 11 when used as the electrographic carrier. On the other hands, the BET specific surface areas of the products obtained in Comparative Examples 1, 5 and 7 are too large, whereas that of the product obtained in Comparative Example 8 is too small. These products as a result cannot be used as electrographic carrier core materials. The magnetizations of the products obtained in Comparative Examples 2 and 4 are too low. These products hence cannot be used as electrographic carrier core materials. The magnetization of the product obtained in Comparative Example 3 is not only too high after the final sintering but is also too low after the surface oxidation treatment. The product is hence not suitable to be used as an electrographic carrier core material. The residual magnetization and coerce force of the product obtained in Comparative Example 6 are too low after the final sintering. The product is hence not suitable to be used as an electrographic carrier core material.

EXAMPLE 12

The carrier core material particle having an average particle size of 58.45 μm was produced in the same manner as in Example 1, and an acrylic modified silicone resin, KR-9706, product of Shin-Etsu Silicones, was applied as a coating resin using a universal mixer/stirrer. The resin solution used at this step was a solution prepared by weighing the resin so that a resin solid content is 0.5% by weight of the carrier core material and adding thereto a solvent wherein toluene and MEK were mixed in a weight ratio of 3:1 so that a resin solid content is 10% by weight. After the application, the resin was dried for 3 hours using a hot-air dryer set at 210° C. to thoroughly remove the volatile matter, thereby obtaining the resin coated carrier.

EXAMPLE 13

The carrier core material particle having an average particle size of 58.45 μm was produced in the same manner as in Example 1, and a silicone resin, SR-2411, product of Toray Dow Corning, was applied as a coating resin using a universal mixer/stirrer. The resin solution used at this step was a solution prepared by weighing the resin so that a resin solid content is 0.5% by weight of the carrier core material and adding thereto toluene so that a resin solid content is 10% by weight. After the application, the resin was dried for 3 hours using a hot-air dryer set at 220° C. to thoroughly remove the volatile matter, thereby obtaining the resin coated carrier.

EXAMPLE 14

The carrier core material particle having an average particle size of 58.45 μm was produced in the same manner as in Example 1, and an acrylic resin, LR-269, product of Mitsubishi Rayon, was applied as a coating resin using a universal mixer/stirrer. The resin solution used at this step was a solution prepared by weighing the resin so that a resin solid content is 1.0% by weight of the carrier core material and adding thereto toluene so that a resin solid content is 10% by weight. After the application, the resin was dried for 2 hours using a hot-air dryer set at 145° C. to thoroughly remove the volatile matter, thereby obtaining the resin coated carrier.

In regard to Examples 12 to 14, the measurement results of the charge levels after the resin application are shown in Table 5. The method for measuring the charge level is as described earlier.

TABLE 5

| | Coating resin | Amount coated | Charge level (μC/g) |
|---|---|---|---|
| Example 12 | Acrylic-modified silicone resin | 0.5 wt % | 45.3 |
| Example 13 | Silicone resin | 0.5 wt % | 37.4 |
| Example 14 | Acrylic resin | 1.0 wt % | 72.3 |

The results of Examples 12 to 14 revealed that the electrographic carriers having sufficient charge properties can be obtained by coating the carrier core material of the present invention with various resin films.

Industrial Applicability

The carrier core material for electrophotographic developer of the present invention provides high magnetization, yet the intended resistivity of medium or high resistivity, and a high charge level and good charge stability together with the surface properties having the right degree of ruggedness and uniform topography without using various heavy metals or Mn in an amount more than necessary. Further, the electrophotographic developer composed of the toner and carrier obtained by covering the above carrier core material with a resin has an extended developer life and has a high charge level with good charge stability. According to the production process of the present invention, the above carrier core material and carrier can be stably produced in an industrial scale.

Consequently, the present invention can be widely used in the fields of the full color developing apparatuses which require high image quality and apparatuses used for high speed printing which require reliability and endurance in image maintenance.

What is claimed is:

1. A carrier core material for an electrophotographic developer comprising 0.8 to 5 by weight of Mg, 0.1 to 1.5% by weight of Ti, 60 to 70% by weight of Fe, 0.1 to 10% by weight of Mn and 0.2 to 2.5% by weight of Sr, has an amount of Sr dissolved with a pH4 standard solution of 80 to 1000 ppm, and has a shape factor SF-2 (circularity) of 100 to 120.

2. The carrier core material for an electrophotographic developer according to claim 1, containing an oxide crystal structure containing at least Fe and Ti in addition to the spinel structure forming an Mg ferrite.

3. The carrier core material for an electrophotographic developer according to claim 1, wherein a true density is 4.5 to 5.3 $g/cm^3$.

4. The carrier core material for an electrophotographic developer according to claim 1, wherein a charge level of the core material is 0.8 to 2 times relative to a Mn-Mg ferrite core material.

5. The carrier core material for an electrophotographic developer according to claim 1, wherein a BET specific surface area is 0.075 to 0.15 $m^2/g$.

6. The carrier core material for an electrophotographic developer according to claim 1, wherein a magnetization is 55 to 85 $Am^2/kg$, a residual magnetization is 2 to 10 $Am^2/kg$, and a coercive force is 10 to 80 $3K\cdot1000/4\pi\cdot A/m$, when a magnetic field of $3K\cdot1000/4\pi\cdot A/m$ is applied.

7. The carrier core material for an electrophotographic developer according to claim 1, wherein an average particle size is 15 to 120 μm when measured using a laser diffraction particle size distribution analyzer.

8. The carrier core material for an electrophotographic developer according to claim 1, wherein a volume resistivity is $1\times10^6$ to $1\times10^{10}$ Ω·cm at an applied voltage of 50 V.

9. The carrier core material for an electrophotographic developer according to claim 1, which is subjected to surface oxidation treatment to form an oxide film thereon.

10. The carrier core material for an electrophotographic developer according to claim 9, wherein a volume resistivity is $1\times10^{6}$ to $1\times10^{10}$ Ω·cm at an applied voltage of 50 V and a volume resistivity is $6\times10^{5}$ to $1\times10^{10}$ Ω·cm at an applied voltage of 1000 V.

11. A carrier for an electrophotographic developer having the carrier core material according claim 1 with the surface thereof coated with a resin.

12. The carrier for an electrophotographic developer according to claim 11, wherein the resin is an acrylic resin, silicone resin or modified silicone resin.

13. An electrophotographic developer comprising the carrier of claim 11 and a toner.

14. The electrophotographic developer according to claim 13 which is used as a replenishing developer.

15. A carrier core material for an electrophotographic developer comprising 0.8 to 5% by weight of Mg, 0.1 to 1.5% by weight of Ti, 60 to 70% by weight of Fe, 0.1 to 10% by weight of Mn and 0.2 to 2.5% by weight of Sr, and has an amount of Sr dissolved with a pH4 standard solution of 80 to 1000 ppm, wherein an average particle size is 15 to 120 μm when measured using a laser diffraction particle size distribution analyzer.

* * * * *